US006589103B2

(12) United States Patent
Müller et al.

(10) Patent No.: US 6,589,103 B2
(45) Date of Patent: Jul. 8, 2003

(54) DEVICE FOR THE FINISHING TREATMENT OF SHAFT WORKPIECES

(75) Inventors: Werner Max Müller, Essen (DE); Andreas Thölke, Oldenburg (DE)

(73) Assignee: Ernst Thielenhaus GmbH & Co. KG, Wuppertal (DE)

( * ) Notice: Subject to any disclaimer, the term of this patent is extended or adjusted under 35 U.S.C. 154(b) by 112 days.

(21) Appl. No.: 09/796,867

(22) Filed: Mar. 1, 2001

(65) Prior Publication Data

US 2001/0031613 A1 Oct. 18, 2001

(30) Foreign Application Priority Data

Mar. 3, 2000 (DE) ..... 100 09 980

(51) Int. Cl.[7] ..... B24B 1/00; B24B 7/00; B24B 9/00

(52) U.S. Cl. ..... 451/65; 451/49; 451/62; 451/324; 451/385; 451/302; 451/399

(58) Field of Search ..... 451/49, 62, 65, 451/66, 312, 324, 365, 385, 397, 398, 399, 302, 303

(56) References Cited

U.S. PATENT DOCUMENTS 5,150,545 A * 9/1992 Esteve ..... 451/8
5,755,615 A * 5/1998 Kiriyama ..... 451/49
5,775,974 A * 7/1998 Hulsebus ..... 451/49
5,984,767 A * 11/1999 Pineau et al. ..... 451/49
6,220,946 B1 * 4/2001 Arnold ..... 451/307

FOREIGN PATENT DOCUMENTS

DE 196 07 776 9/1997

* cited by examiner

*Primary Examiner*—Timothy V. Eley
(74) *Attorney, Agent, or Firm*—Collard & Roe, P.C.

(57) ABSTRACT

The invention relates to a device for the finishing treatment of shaft workpieces, in particular crankshafts and camshafts. The device comprises a carrier, at least one jaw for exerting contact pressure on the workpiece, and a linear guide for guiding the jaw. The linear guide is supported by a transverse guide to form a cross guiding system which follows the rotational motion of the workpiece by revolving around its axis of rotation. The transverse guide contains a main carriage guided on the carrier. The main carriage is radially aligned with respect to the axis of rotation of the workpiece. The main carriage has a fork-shaped head facing towards the side of the workpiece. A guide rail for the linear guide is chucked between the between the legs of the fork-like head.

5 Claims, 2 Drawing Sheets

DEVICE FOR THE FINISHING TREATMENT OF SHAFT WORKPIECES

BACKGROUND OF THE INVENTION

1. Field of the Invention

The invention relates to a device for the finishing treatment of shaft workpieces. The device comprises a carrier, at least one jaw for exerting contact pressure on the workpiece, and a linear guide for the jaw.

2. The Prior Art

Finishing treatment devices are known from German Patent No. A 196 07 776. In this case, the device comprises two jaws exerting contact pressure, arranged on arms of linear guides. The arms, in turn, are guided on a portal-like transverse carrier, and are connected with each other by an electro-mechanical or hydraulic chucking device. The contact pressure for the finishing treatment is generated by the chucking device. The device is equipped with four guides which has high construction costs. Since the arms are long and are guided on a transverse carrier, the device has relatively low rigidity. This rigidity varies depending on the position the jaws are located on the arms. Finishing defects may occur in the finishing treatment as a result of such inadequate stiffness. Furthermore, when a workpiece is loaded and unloaded, problems may occur because the jaws may be displaced against each other in the longitudinal direction of the arms. Costly and precise operating positioning devices are needed so that the jaws will maintain defined positions during a workpiece change.

SUMMARY OF THE INVENTION

The invention provides a compact and structurally simple device having only a few moving components for the finishing treatment of shafts. This device provides high and invariable rigidity by virtue of its construction.

The present invention accomplishes these and other objects by providing a transverse guide consisting of a main carriage guided on a carrier. The main carriage is radially aligned with respect to the axis of rotation of the workpiece and the main carriage contains a fork-shaped head located on the side facing the workpiece. A guide rail is disposed on a linear guide of the jaw, and is inserted between the legs of the fork-shaped head at a right angle relative to the direction of movement of the transverse guide. In the course of treatment of the workpieces, the guide of the main carriage is free of bending moments, so as to assure a smooth and precise guidance of the transverse guide. The two jaws are movably guided on the guide rail, whereby the working surfaces of the jaws extend around the workpiece. The working surfaces can be fitted with hones or designed for operating with a finishing belt. To generate the contact pressure required for the finishing treatment, the jaws can be connected to each other by an electromechanical, hydraulic or pneumatic chucking device. The adjustment range of the chucking device is designed so that the jaws can opened for loading and unloading a workpiece.

The jaws are in the form of cantilevered structural components and contain a carriage at their rearward ends. The carriage is guided on the guide rail. The working surface is located at the projecting ends of the jaws, and extends around the workpiece in a curved manner.

When the main portion and the lifting bearings of a crankshaft or a camshaft are worked for finishing purposes, a multitude of the devices can be arranged next to one another in the longitudinal direction of the workpiece. After the finishing treatment of the workpiece is completed, the jaws are opened and the workpiece is removed. The insertion of a new workpiece is substantially simplified if the main carriages of the devices maintain their positions. According to a preferred embodiment of the invention, the main carriage has a rearward end that projects beyond the carrier. This end can be locked when the workpiece is not being operated. A positioning device, as well as a chucking device, are preferably associated with the rearward end, which has a profile section cooperating with the positioning device. When the positioning device is actuated, the main carriage is in a position that is preset by the profile section of the rearward end. Furthermore, by actuating the chucking device, the rearward end can be fixed in any desired position.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
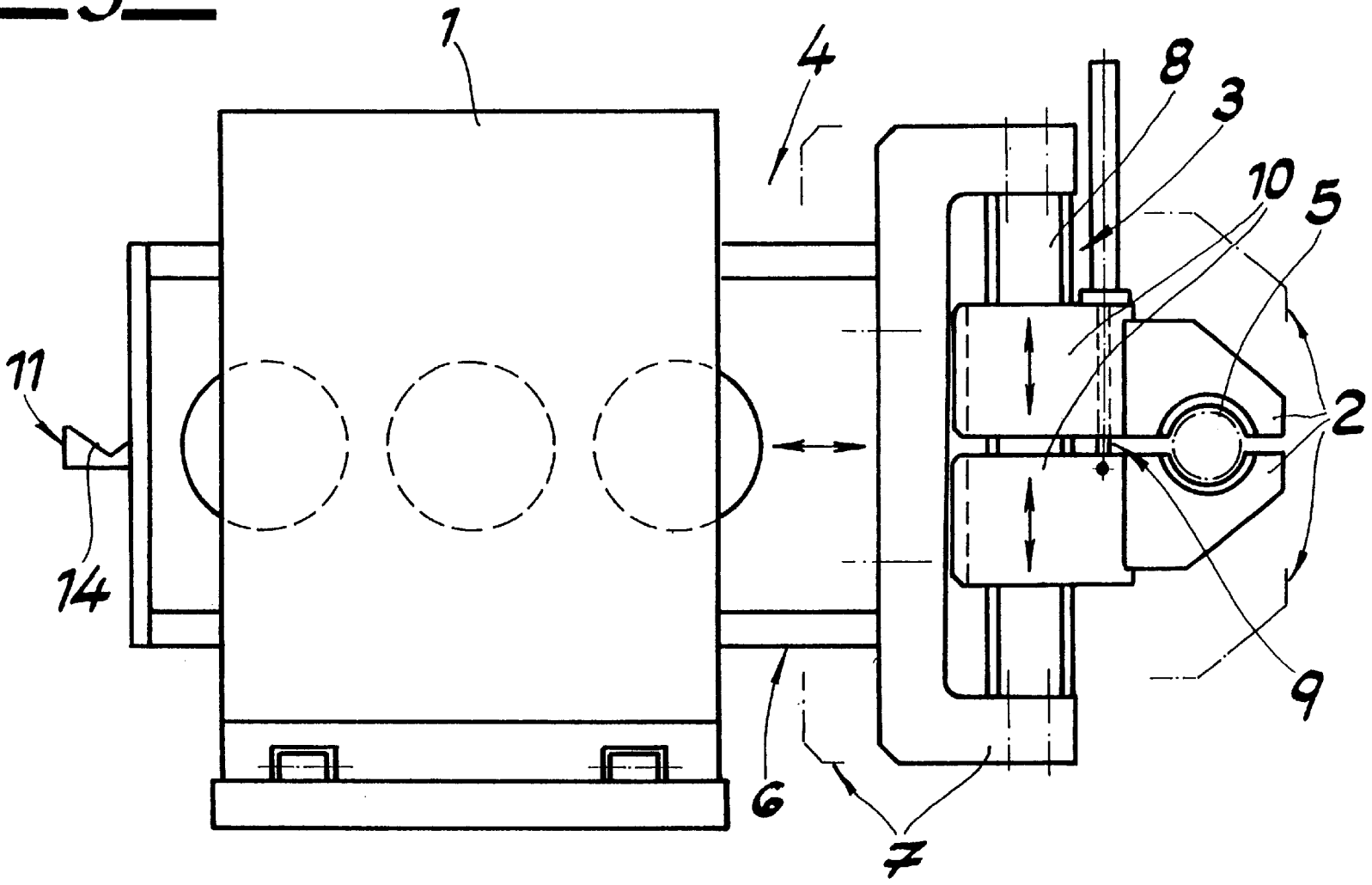
FIG. 1 shows a device according to the invention for the finishing treatment of the lifting bearings of a crankshaft.

Referring now in detail to the drawings and, in particular FIG. 1, a carrier 1 is shown having at least one jaw 2 for exerting contact pressure on a workpiece 5. A linear guide 3 is provided for guiding jaw 2. Linear guide 3 and a cross guide 4, which supports the linear guide, form a cross guide system. This system follows the rotational motion of workpiece 5 by revolving around its axis of rotation. In the finishing treatment of a crankshaft, a plurality of the devices shown are arranged next to each other in the longitudinal direction of the workpiece. The rotational drive for rotating the workpiece and an axial oscillation drive are not shown.

Cross guide 4 comprises a main carriage 6 that is guided on carrier 1. Main carriage 6 has a fork or C-shaped head 7 facing workpiece 5. A guide rail 8, disposed on linear guide 3, is inserted between the legs of fork-like head 7. The guiding surfaces may be protected by a movable cover, for example in the form of folding bellows. Two jaws 2 are movably guided on guide rail 8. The working surfaces of jaws 2 extend around workpiece 5. Three working surfaces may be fitted and covered with honing stones laid open to operate as a finishing belt. Jaws 2 are connected to each other by a chucking device 9. In a preferred embodiment of the invention, a hydraulic chucking system 9 is provided. However, such a chucking system may also be an electromechanical or a pneumatic system.

Main carriage 6 is radially aligned with respect to the axis of workpiece 5. Main carriage 6 has a rearward end 11 projecting beyond the carrier. The adjusting movements of main carriage 6 and jaws 2 occur as the workpiece is rotating, as indicated in FIG. 1 by dashed lines.

Jaws 2 are in the form of cantilevered structural components, and have a slide 10 located at their rearward ends. Slide 10 is guided on the guide rail. A working surface is located on the projecting ends of jaws 2, which extend around the workpiece in a curved manner.

Figure 2:
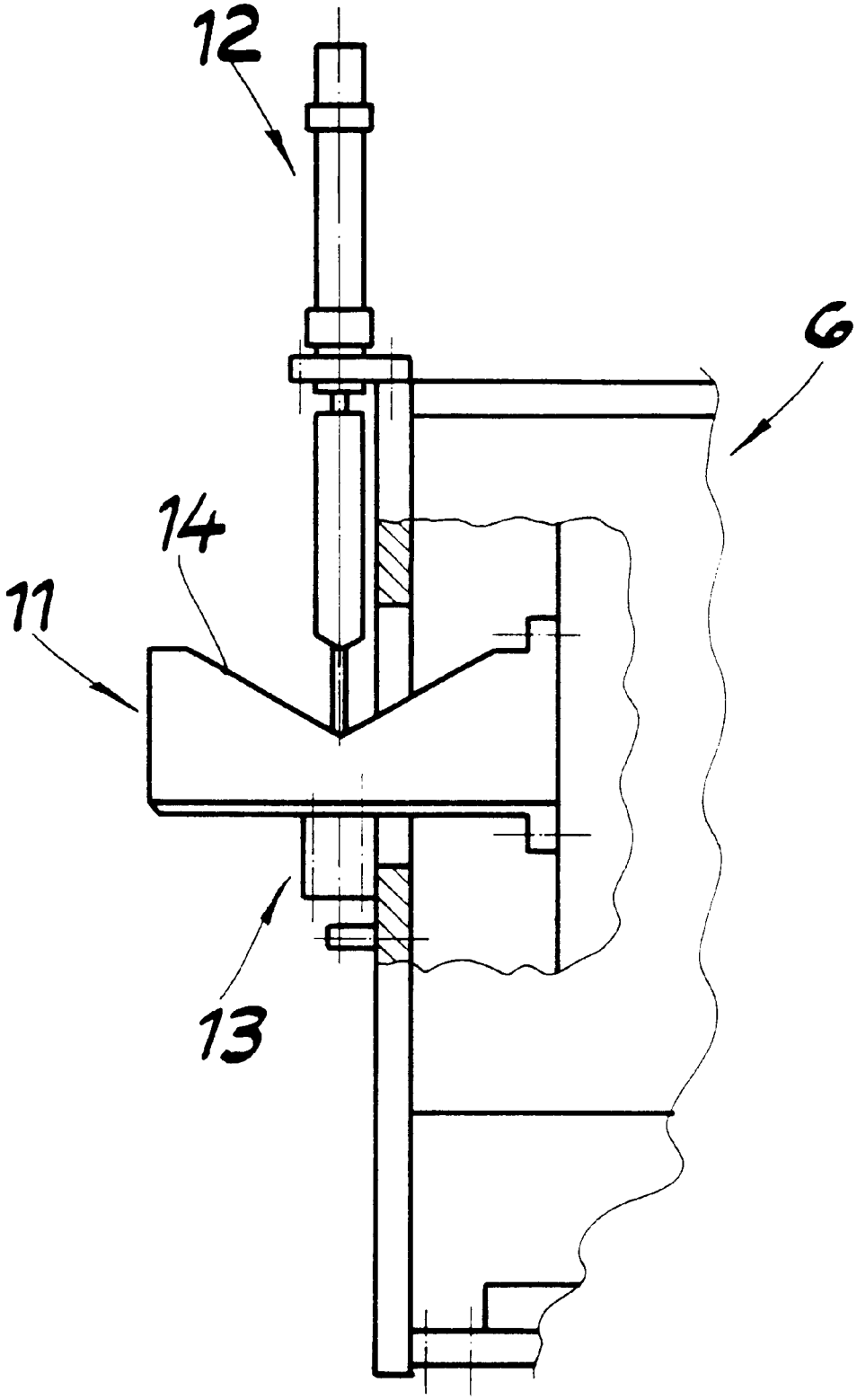
FIG. 2 shows a positioning and chucking device mounted on the rearward end of the device.

FIG. 2 shows end 11 of main carriage 6 being positioned and locked when the workpiece is not being treated. The system shown in FIG. 2 comprises a positioning device 12 as well as a chucking device 13.

Positioning device 12 cooperates with a profile section 14 of rearward end 11. By actuating positioning device 12, main carriage 6 is driven into a position that is preset by profile section 14. When the device is loaded with a new workpiece, main carriages 5 are driven by their associated positioning devices 12 into a center position that is preset by profile section 14. When jaws 2 are spread far apart, workpiece 5, for example a crankshaft, is inserted into the device. The main bearing surfaces of the workpiece disposed in the axis of rotation are chucked first. The lifting bearing surfaces of the workpiece to be worked are then successively driven into the positions "12 o'clock" and "6 o'clock", respectively. Jaws 2 associated therewith are driven against the lifting bearing surfaces to be finished. As soon as jaws 2 are placed against the lifting bearing surface to be worked, positioning device 12 is released, so that main carriage 6 can now move freely. These process steps are repeated until all jaws 2 are in place against the lifting bearing surfaces to be treated. This completes the "teach in" phase, and a series production can now be started.

After the finishing treatment of the first workpiece has en completed, the finished piece is driven into a determined angular position. Before the finished workpiece 5 is removed, main carriages 6 are fixed by their associated chucking devices 13 in the positions determined by the angular position of the workpiece. The finished workpiece 5 can now be moved and a new workpiece can then be inserted for treatment thin the framework of the series production.

Accordingly, while only a single embodiment of the present invention has been shown and described, it is obvious that many changes and modifications may be made thereunto without departing from the spirit and scope of the invention.

What is claimed is:

1. A device for finishing treatment of a shaft workpiece, comprising:

a carrier;

a cross guiding system comprising:

a linear guide having a guide rail and a transverse main carriage guided on said carrier and radially aligned with respect to the axis of rotation of the workpiece, wherein said main carriage has a fork-shaped head supporting said linear guide; and two jaws movably guided on said guide rail, wherein each jaw has a working surface that extends around and exerts contact pressure on the workpiece, and wherein said at least one jaw being disposed on said linear guide;

wherein said cross guiding system follows a rotational movement of the workpiece.

2. The device according to claim 1, wherein said two jaws are connected to each other by an electromechanical, hydraulic or pneumatic chucking system.

3. The device according to claim 1, wherein said two jaws comprise cantilevered structural components and a slide located on rearward ends of said two jaws, and said two jaws are guided on said guide rail, wherein said working surfaces extend around a circumference workpiece.

4. The device according to claim 1, wherein said main carriage comprises an end projecting rearwardly beyond said carrier, wherein said end is lockable when the workpiece is not being wetted.

5. The device according to claim 4, further comprising a positioning device, a profile section and a chucking device being disposed at said end, wherein said profile section cooperates with said positioning device and, upon actuation of said positioning device said main carriage is in a position, preset by said profile section, and wherein said end is in any fixed position upon actuation of said chucking device.

* * * * *